US012029996B2

(12) United States Patent
Cecchin et al.

(10) Patent No.: US 12,029,996 B2
(45) Date of Patent: Jul. 9, 2024

(54) ELECTRONIC TOY BRICK

(71) Applicant: ELENCO ELECTRONICS, LLC, Minnetonka, MN (US)

(72) Inventors: Gerald Joseph Cecchin, Buffalo Grove, IL (US); Marc Christoph Lehner, Glenview, IL (US)

(73) Assignee: Elenco Electronics, LLC, Minnetonka, MN (US)

( * ) Notice: Subject to any disclaimer, the term of this patent is extended or adjusted under 35 U.S.C. 154(b) by 0 days.

(21) Appl. No.: 18/311,291

(22) Filed: May 3, 2023

(65) Prior Publication Data

US 2023/0356101 A1 Nov. 9, 2023

Related U.S. Application Data

(60) Provisional application No. 63/339,204, filed on May 6, 2022.

(51) Int. Cl.

| | |
|---|---|
| ***A63H 33/04*** | (2006.01) |
| ***A63H 33/08*** | (2006.01) |
| ***A63H 33/22*** | (2006.01) |
| ***A63H 33/26*** | (2006.01) |

(52) U.S. Cl.

CPC ..... *A63H 33/042* (2013.01); *A63H 33/086* (2013.01); *A63H 33/22* (2013.01); *A63H 33/26* (2013.01)

(58) Field of Classification Search

CPC .... A63H 33/042; A63H 33/08; A63H 33/086; A63H 33/22; A63H 33/26; H01R 12/718; H01R 13/6205

USPC ..... 446/91, 120, 121, 175, 219

See application file for complete search history.

(56) References Cited

U.S. PATENT DOCUMENTS

| | | | | |
|---|---|---|---|---|
| 3,005,282 A | | 10/1961 | Christiansen | |
| 3,696,548 A | * | 10/1972 | Teller | A63H 33/042 446/91 |
| 4,894,040 A | | 1/1990 | Bach et al. | |
| 5,742,486 A | | 4/1998 | Yangkuai | |
| 5,779,515 A | | 7/1998 | Chung | |

(Continued)

FOREIGN PATENT DOCUMENTS

| | | |
|---|---|---|
| CN | 105617685 C | 6/2016 |
| CN | 209333212 Y | 9/2019 |
| EP | 3422444 | 5/2020 |

OTHER PUBLICATIONS

Website screenshot of Snap Circuits BRIC: Structures | Brick & Electronics Exploration Kit; https://www.amazon.com/Snap-Circuits-BRIC-Electronics-Exploration/dp/B07CNDG65B/ref=sr_1_1?crid=N0W1OYP7N1KS&keywords=snap%2Bcircuits%2BSCBRIC1&qid=1679341125&sprefix=snap%2Bcircuits%2Bscbric1%2Caps%2C80&sr=8-1&th=1; obtained on Apr. 26, 2023 (prior art for purposes of prosecution).

(Continued)

*Primary Examiner* — Kien T Nguyen

(74) *Attorney, Agent, or Firm* — Shane Delsman; Godfrey & Kahn, S.C.

(57) ABSTRACT

An electronic toy brick configured to be selectively attached to other toy bricks. One electronic toy brick having at least a top plate with projections, walls, an electrical node for receiving electricity, and a light device electrically coupled to the electrical node. At least one of the top plate and walls are translucent, partially translucent or have a hole to permit light from the light device to exit the toy brick.

22 Claims, 18 Drawing Sheets

(56) References Cited

U.S. PATENT DOCUMENTS

| | | | | |
|---|---|---|---|---|
| 6,443,796 | B1 | 9/2002 | Shackelford | |
| 6,805,605 | B2 | 10/2004 | Reining et al. | |
| 7,144,255 | B2 | 12/2006 | Seymour | |
| 7,273,377 | B2 | 9/2007 | Seymour | |
| 7,611,357 | B2 | 11/2009 | Han et al. | |
| 7,666,054 | B2 | 2/2010 | Glickman et al. | |
| 8,221,182 | B2 | 7/2012 | Seymour et al. | |
| 8,371,894 | B1 | 2/2013 | Rosen et al. | |
| 8,864,546 | B1 | 10/2014 | Capriola | |
| 8,991,040 | B2 | 3/2015 | Chen | |
| 9,168,464 | B2 | 10/2015 | Karunaratne | |
| 9,419,378 | B2 | 8/2016 | Bdeir | |
| 9,531,031 | B2 | 12/2016 | Shaffer, II et al. | |
| 9,597,607 | B2 | 3/2017 | Bdeir | |
| 9,812,034 | B2 | 11/2017 | Shim | |
| 10,252,176 | B1 | 4/2019 | Cecchin et al. | |
| 2009/0215357 | A1 | 8/2009 | Seligman | |
| 2016/0220919 | A1 | 8/2016 | Almog et al. | |
| 2018/0236368 | A1* | 8/2018 | Chen | A63H 33/08 |
| 2019/0165527 | A1* | 5/2019 | Lin | A63H 33/086 |
| 2019/0232185 | A1* | 8/2019 | Lin | H01R 9/2408 |

OTHER PUBLICATIONS

Website screenshot of E-Blox Power Blox Builder—Starter Kit 3D LED Light-Up Building Blocks; https://www.amazon.com/Blox-Power-Blox-Builder-Light-Up/dp/B071L327KC?ref_=ast_sto_dp; obtained on Apr. 26, 2023; (prior art for purposes of prosecution).

Website screenshot of E-Blox Circuit Blox Builder—59 Projects Circuit Board Building Blocks; https://www.amazon.com/Blox-Circuit-Builder-Building-Set/dp/B01MG575LU?ref_=ast_sto_dp; obtained on Apr. 26, 2023; (prior art for purposes of prosecution).

Website screenshot of LED "Four in One" Down Lights—(4) White 1×4 Bricks with White LEDs—USB Powered—Brick Loot; https://www.brickloot.com/collections/lights/products/white-led-down-lights-4-in-a-series-white-1x4-bricks-usb-powered-by-brickloot; obtained on Apr. 26, 2023 (prior art for purposes of prosecution).

Website screenshot of The Original Lite Brix 12-in-1 Light Up Fire Rescue; https://www.kidswhs.com/the-original-lite-brix-12-in-1-light-up-fire-rescue/; obtained on Apr. 26, 2023 (prior art for purposes of prosecution).

Lite Brix Super Light Buildings System (prior art for purposes of prosecution).

Lighted blocks (prior art for purposes of prosecution).

Yisheng Edutainment Integrated Circuit Blocks (prior art for purposes of prosecution).

E-Blox Power Blox (prior art for purposes of prosecution).

Light Stax Illuminated Blocks (prior art for purposes of prosecution).

Search Report and Written Opinion for PCT Application No. PCT/US18/53821 dated Jan. 8, 2019.

"The new Snap Circuits kit adds lighting, audio & moving parts to your LEGO builds" (Kahn) Feb. 15, 2018; retrieved from internet Nov. 25, 2018 (entire document) https://9to5toys.com/2018/02/15/snap-circuits-bric-lego/.

Website screenshot of Light Stax Classic Light Up Building Blocks; https://shorturl.at/eCEGR; obtained on Apr. 26, 2023 (prior art for purposes of prosecution).

* cited by examiner

ELECTRONIC TOY BRICK

CROSS REFERENCE TO RELATED APPLICATION

This application claims the benefit of and priority to U.S. Provisional Patent Application Ser. No. 63/339,204, filed May 6, 2022, the disclosure of which is hereby incorporated by reference herein in its entirety for all purposes.

FIELD

The present disclosure relates generally to the field of toys. More particularly, the present disclosure relates to electronic toy bricks that can be used to build a structure.

BRIEF DESCRIPTION OF THE DRAWINGS

Toy building blocks are configured to be mated to one another to build various structures. Snap-together electronic toys are configured to be snapped-together to complete various electric circuits. However, typically toy building blocks and snap-together electronic toys are not configured to be attached to one another. This reduces the ways these toys can be used and limits the structures that can be built. One example of an adapter is disclosed in U.S. Pat. No. 10,252,176, owned by the Applicant and which is hereby incorporated by reference herein in its entirety for all purposes.

An electric toy brick and method is needed to allow toy building blocks and snap-together electronic toys to be attached to one another. In one embodiment, the building bock adapted is a lighted building block or toy brick that provides lighting to the toy building blocks by using the snap-together electronic toys together.

Embodiments of the lighted toy brick are disclosed with reference to the accompanying exemplary drawings, which are for illustrative purposes. It will be understood by those skilled in the art that one or more aspects of this invention can meet certain objectives, while one or more other aspects can lead to certain other objectives. Other objects, features, benefits, and advantages of the present invention will be apparent in the summary and descriptions of the disclosed embodiment(s), and will be readily apparent to those skilled in the art. Such objects, features, benefits, and advantages will be apparent from that previously described taken in conjunction with the accompanying figures and all reasonable inferences to be drawn therefrom.

Figure 1:
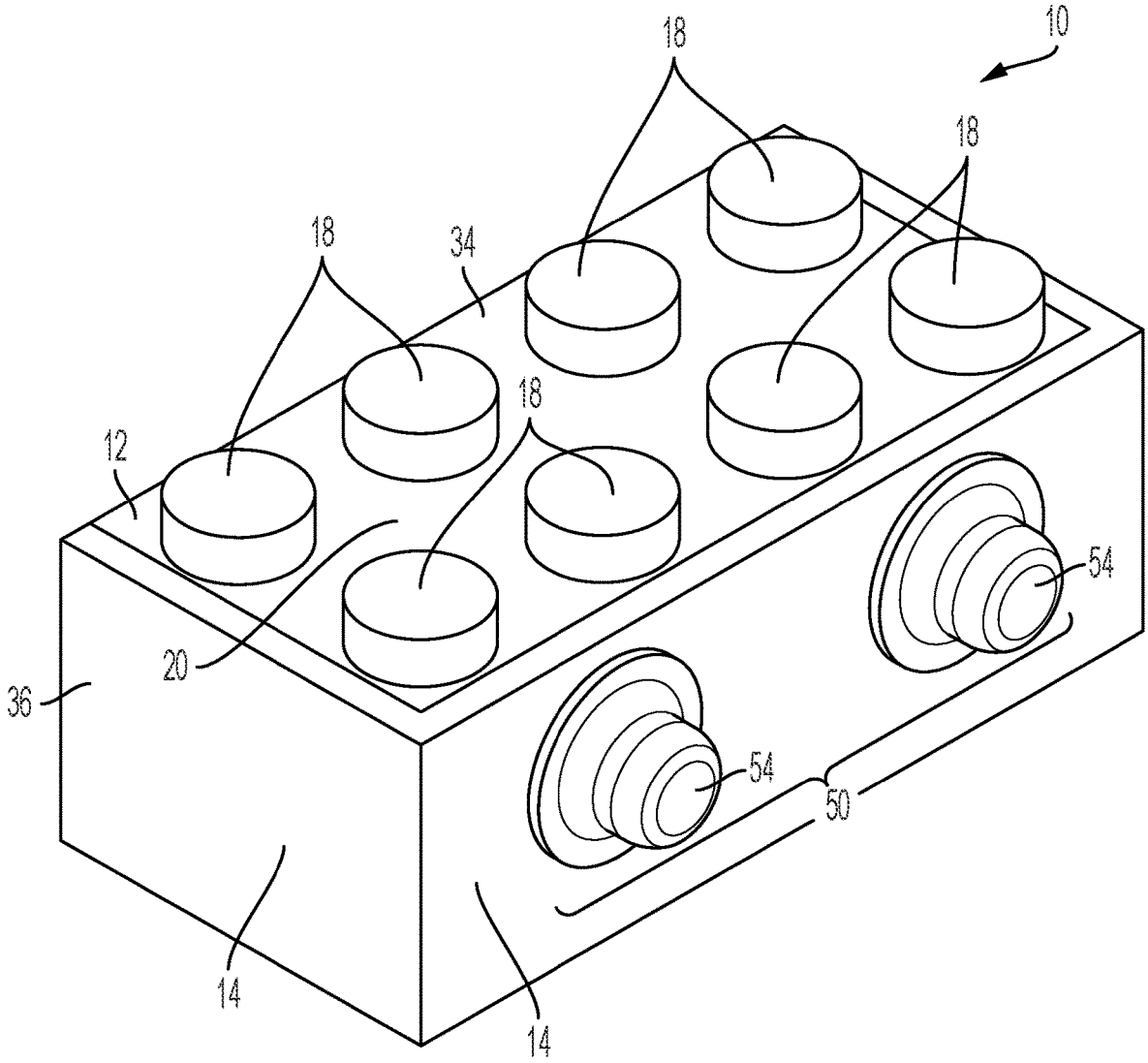

FIG. 1 is a top, right perspective view of one embodiment of a toy brick.

Figure 2:
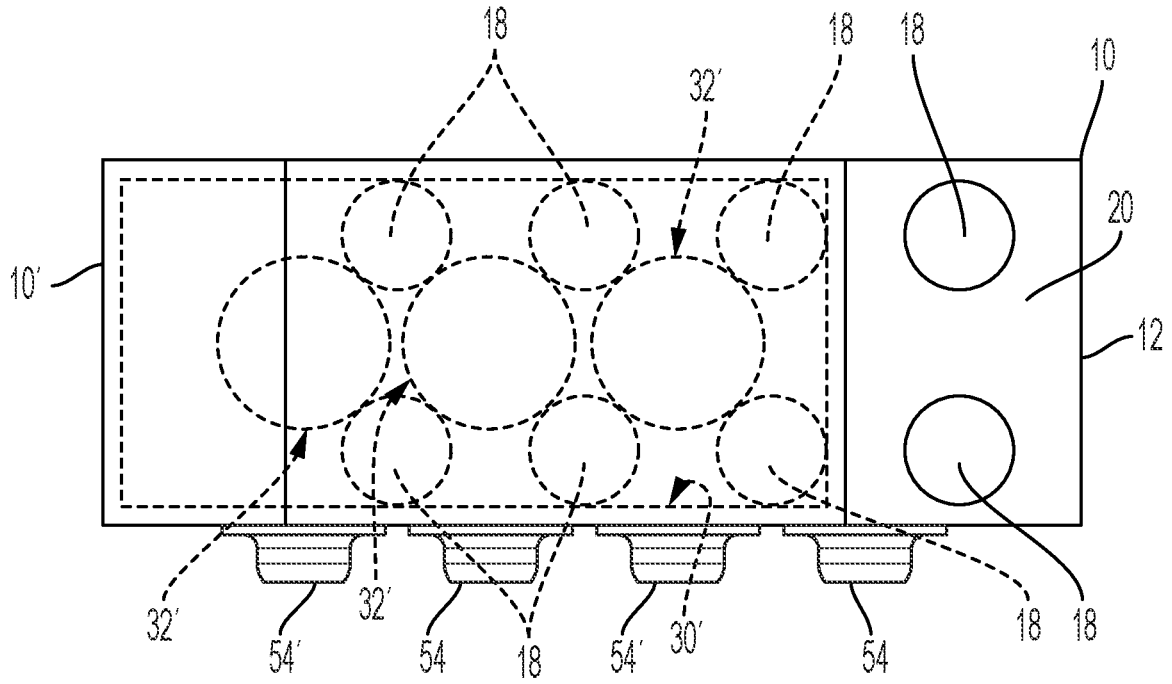

FIG. 2 is a top plan view of the toy brick of FIG. 1 attached to another toy brick.

Figure 3:
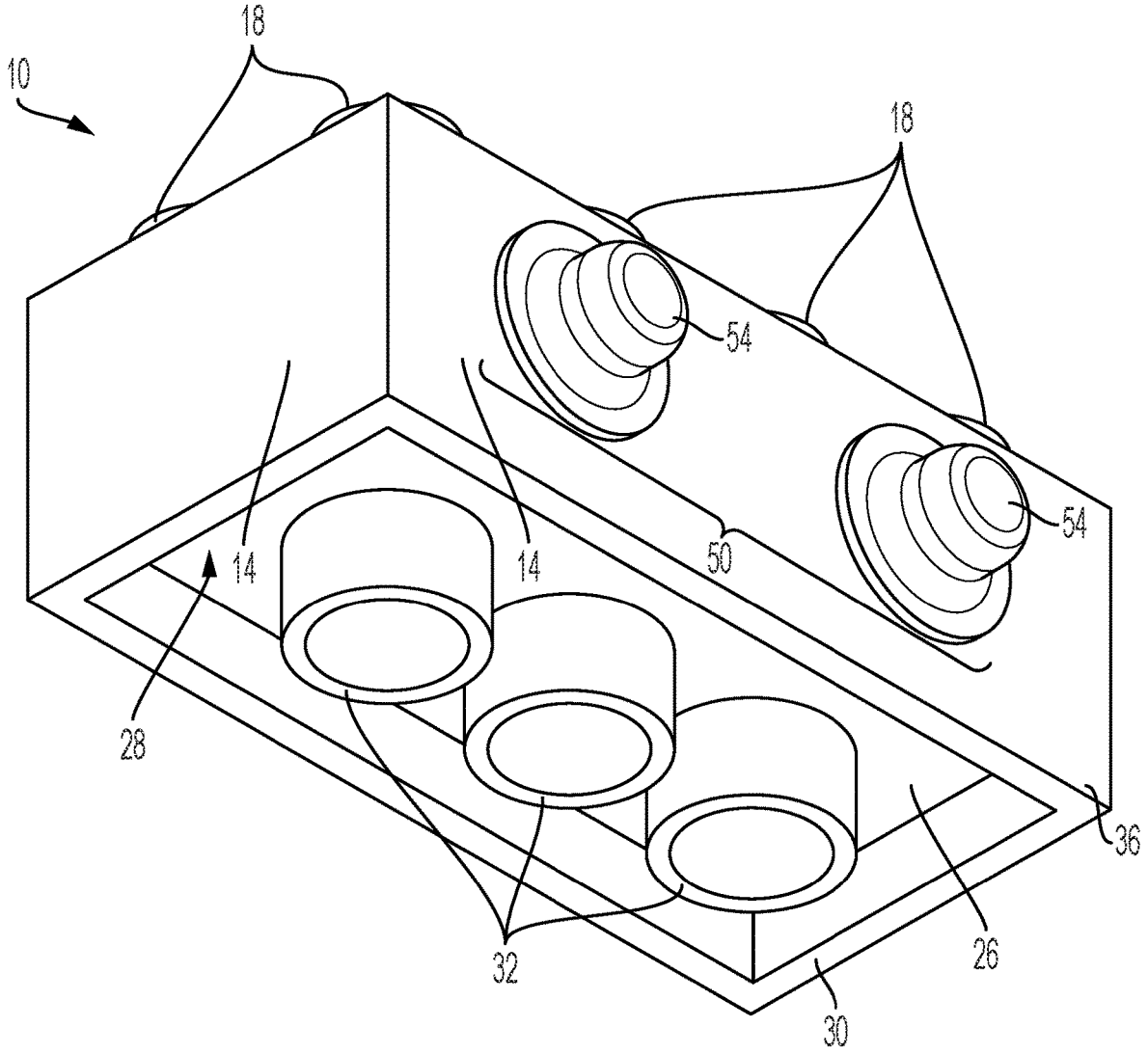

FIG. 3 is a bottom, right perspective view of the toy brick of FIG. 1.

Figure 4:
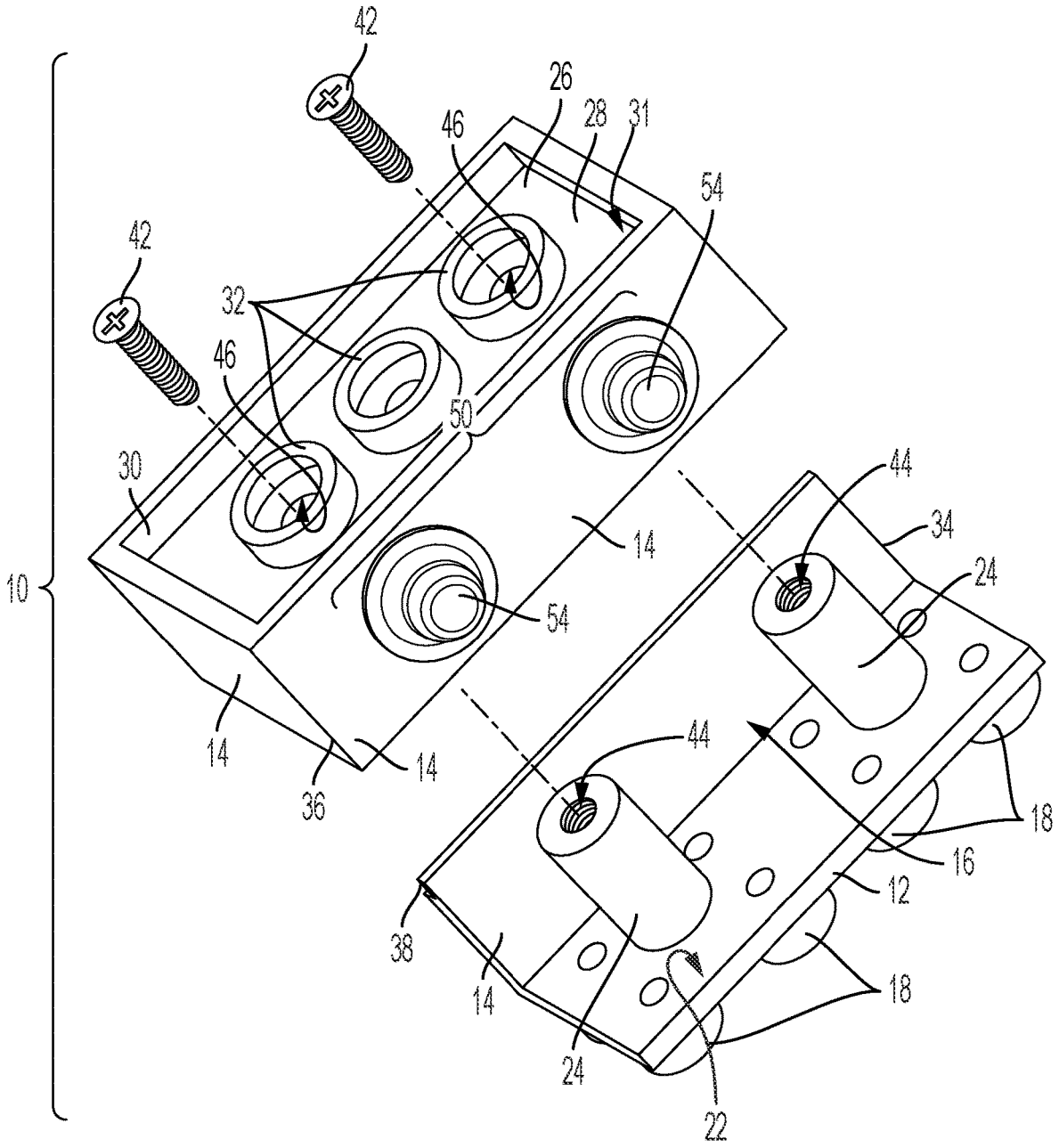

FIG. 4 is a perspective partially exploded view of the toy brick of FIG. 1.

Figure 5:
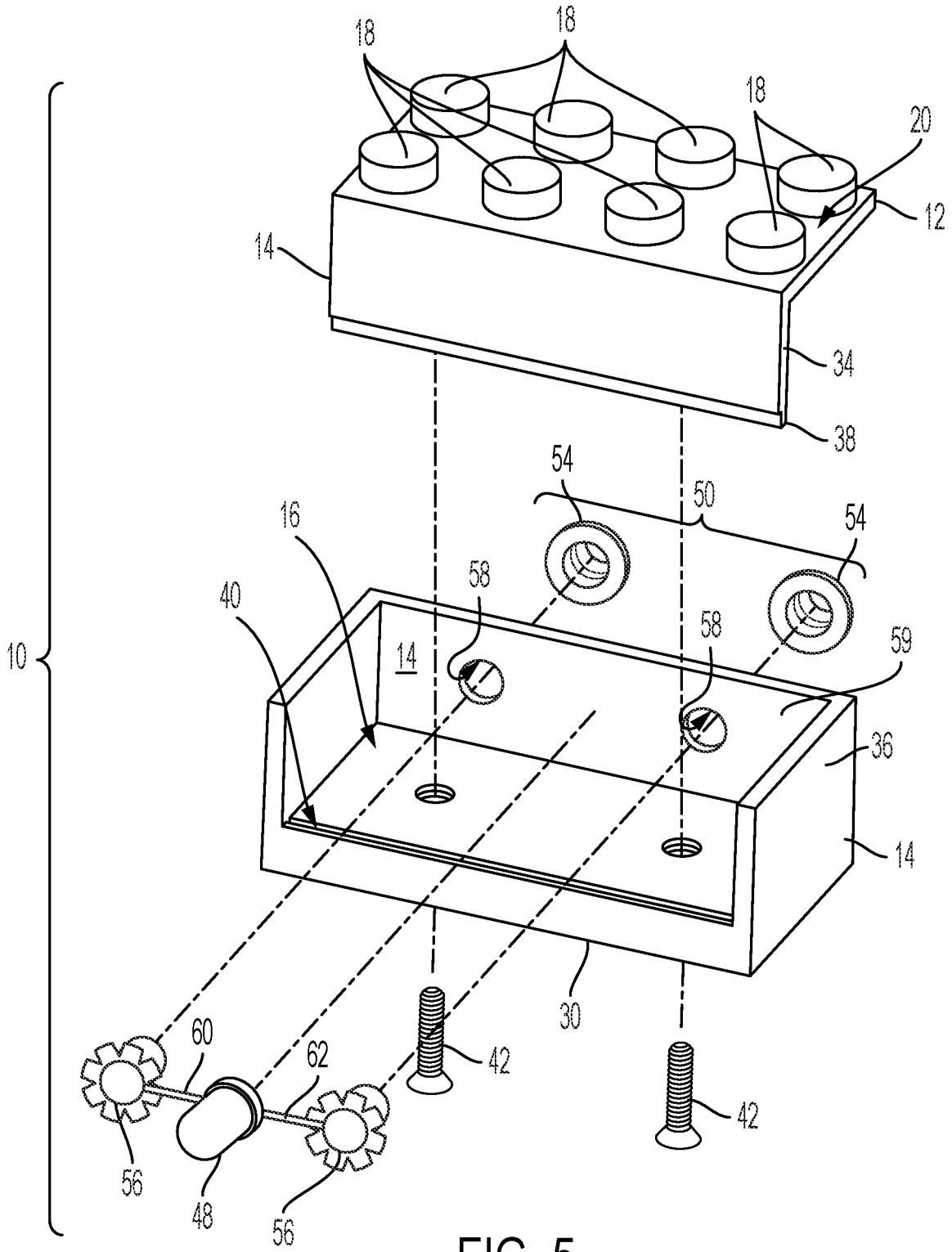

FIG. 5 is a perspective exploded view of the toy brick of FIG. 1.

Figure 6:
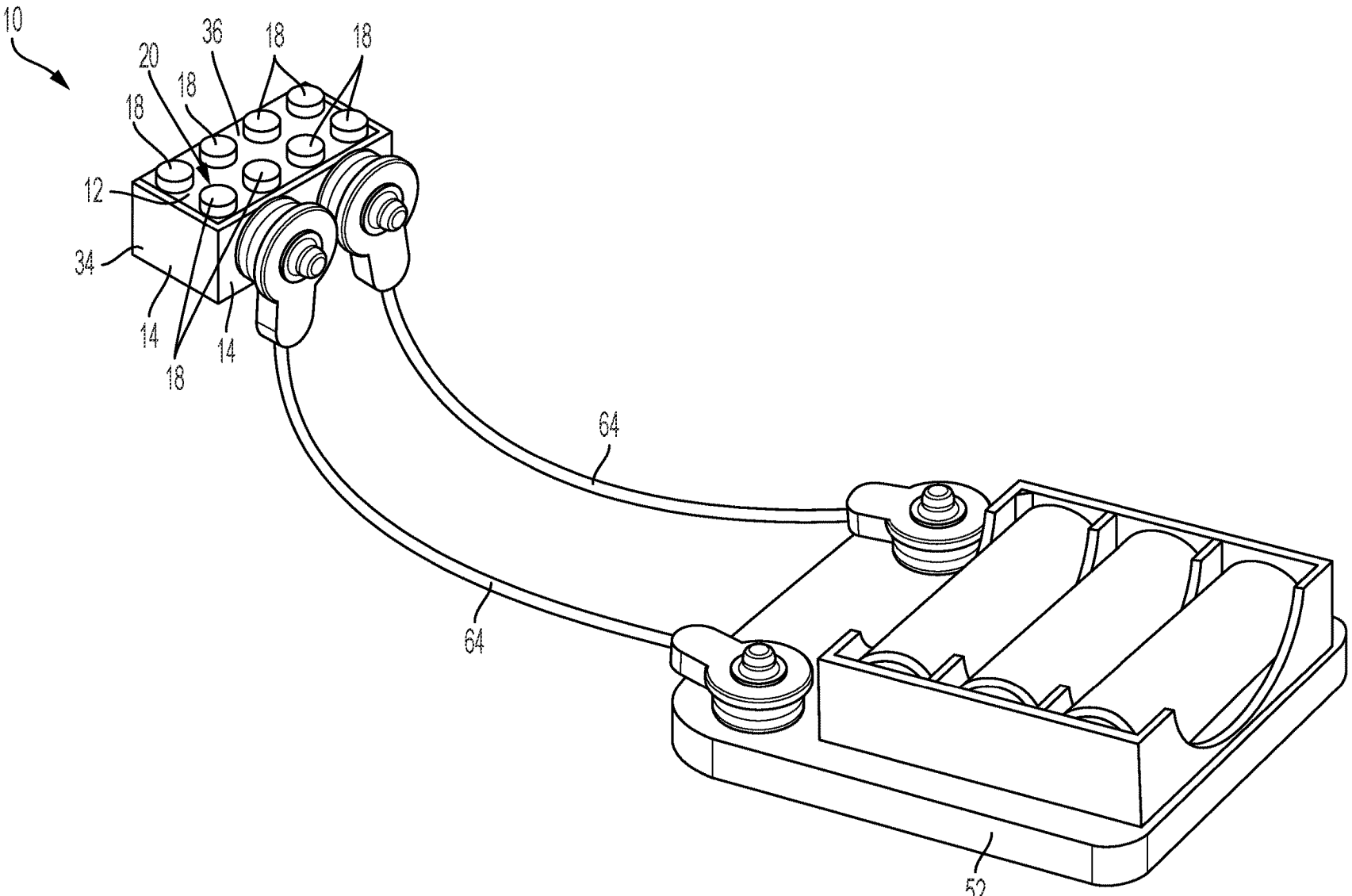

FIG. 6 is a perspective view of the toy brick of FIG. 1 attached to a power source.

Figure 7:
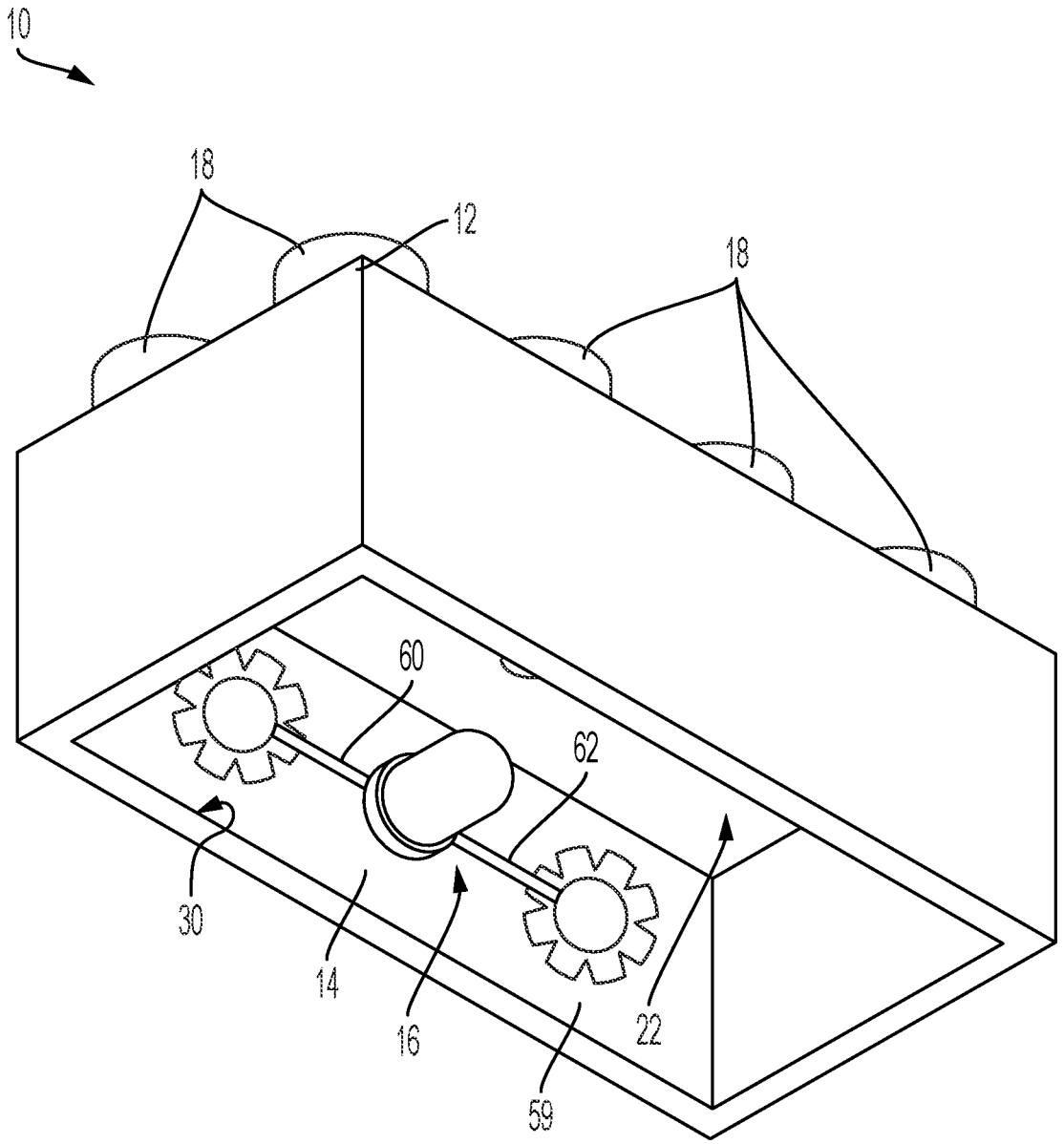

FIG. 7 is a bottom, right perspective view of an alternative embodiment of a toy brick.

Figure 8:
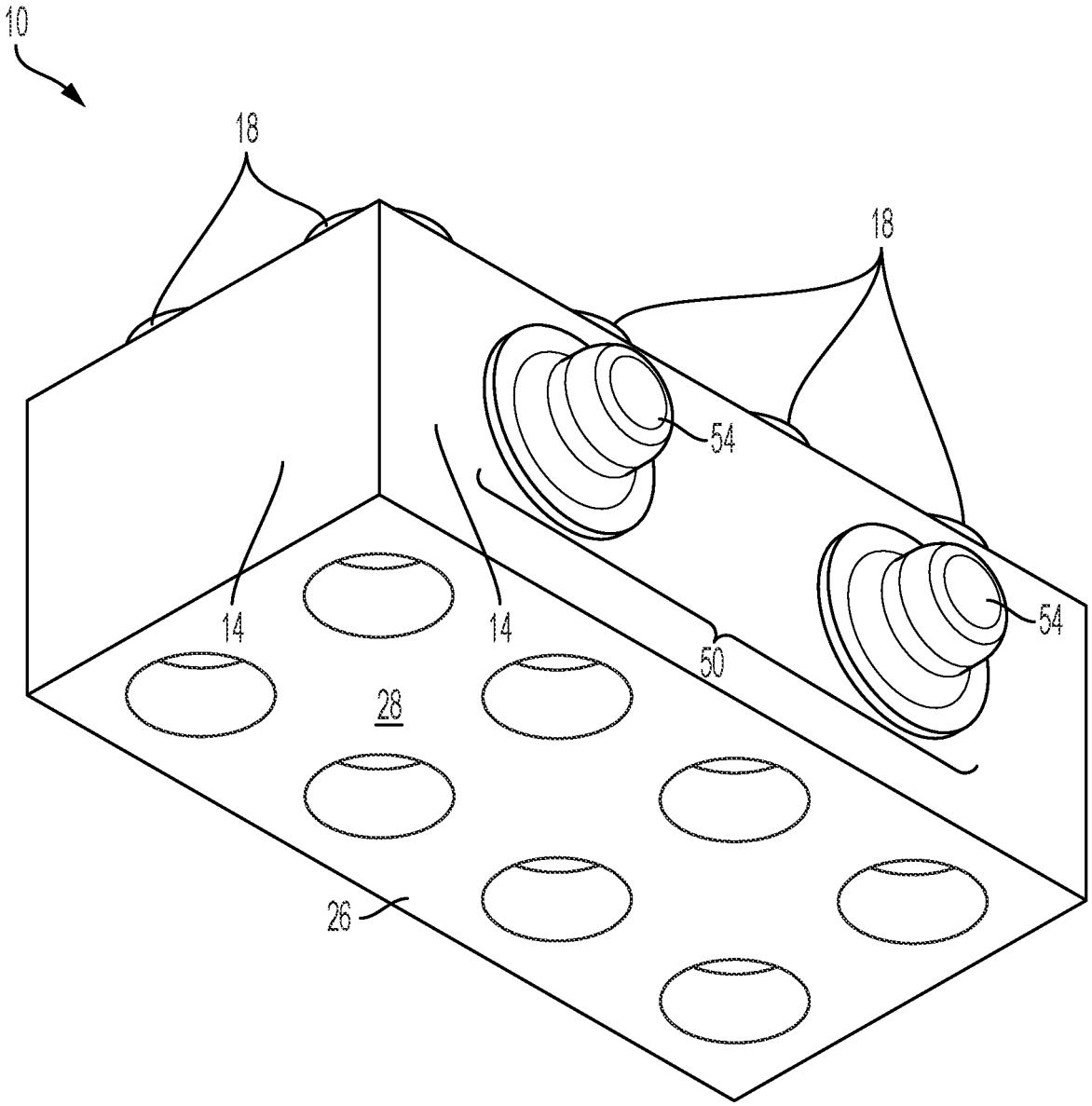

FIG. 8 is a bottom, right perspective view of another embodiment of a toy brick.

Figure 9:
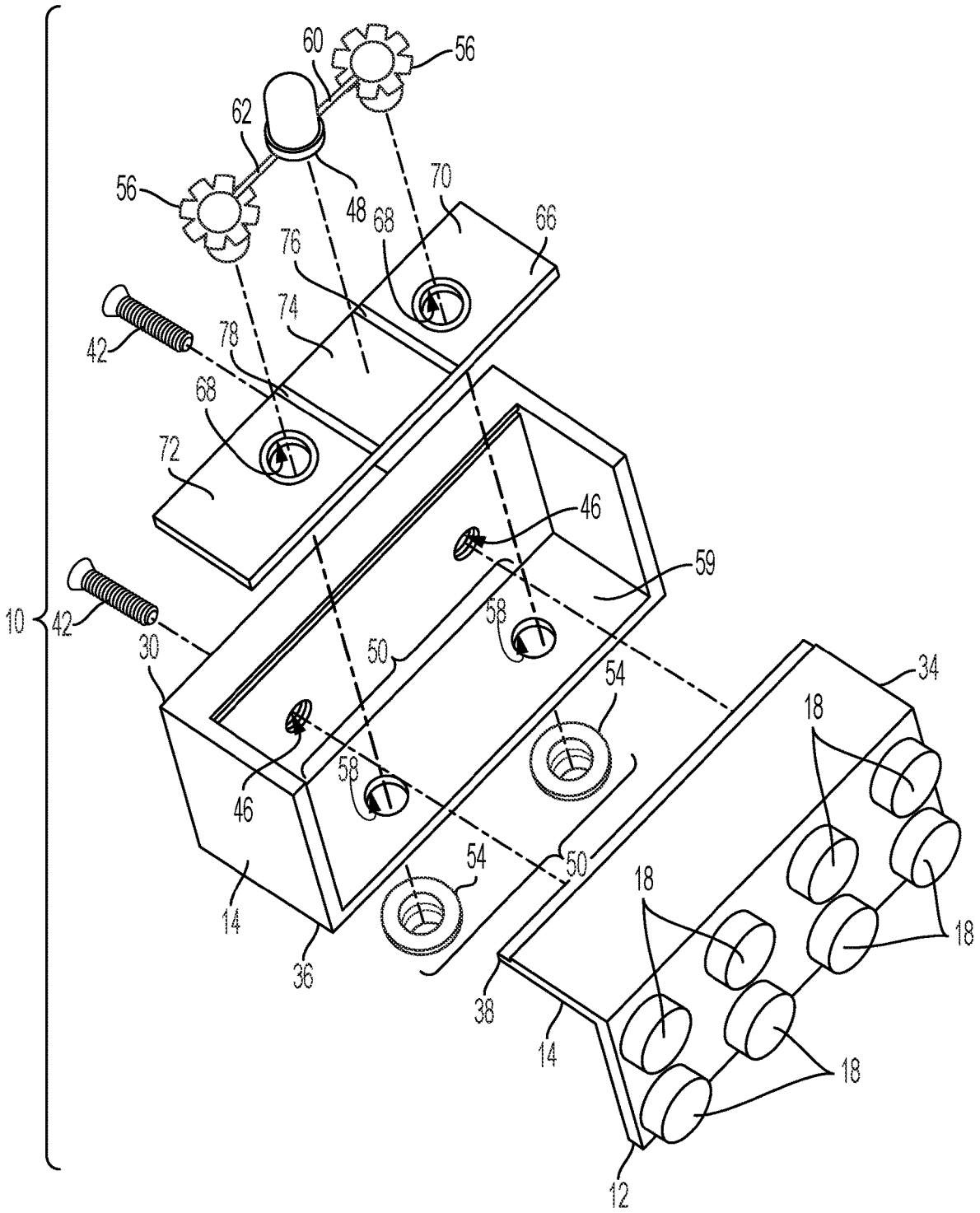

FIG. 9 is a perspective partially exploded view of an alternative embodiment of a toy brick.

Figure 10:
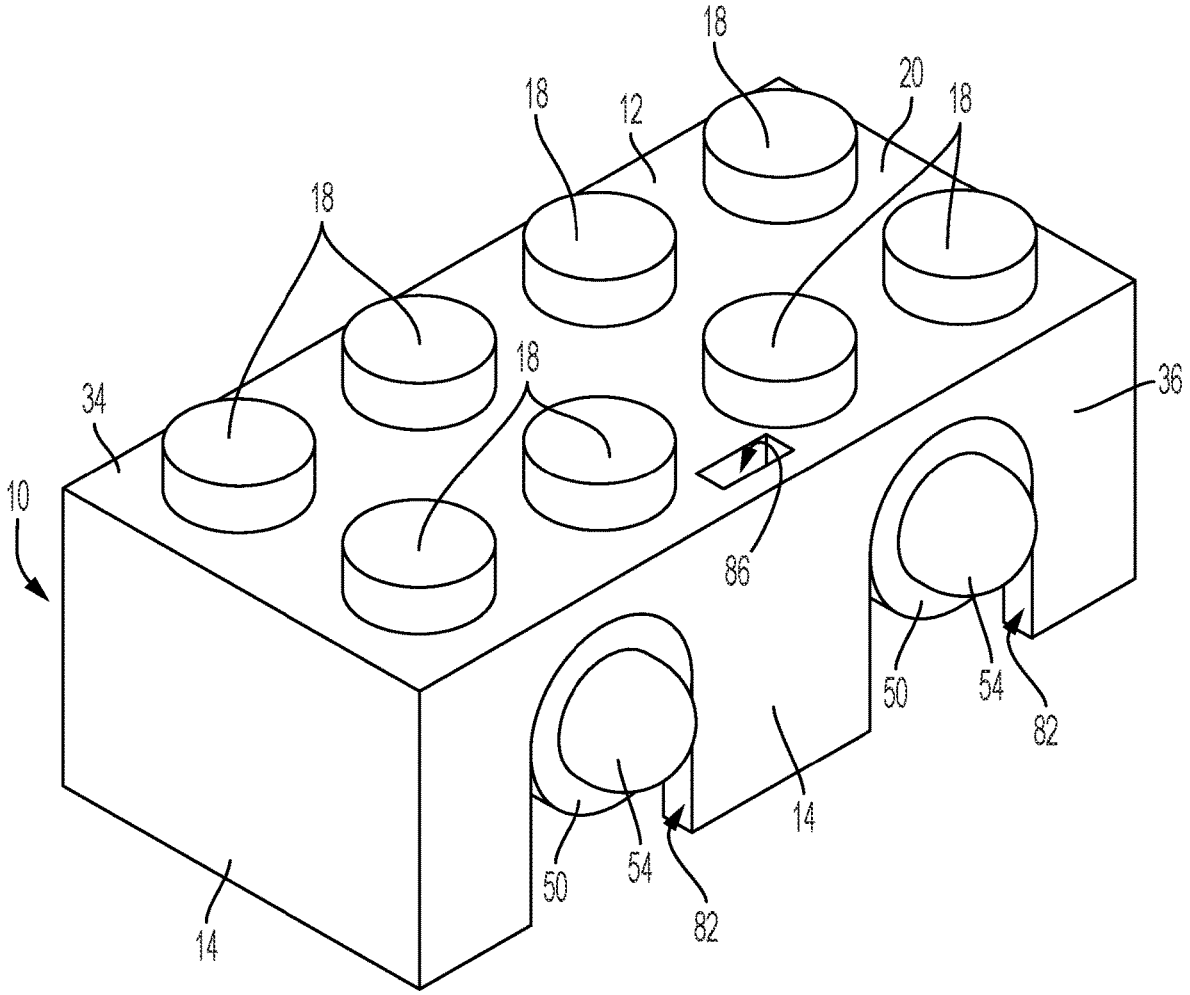

FIG. 10 is a top, right perspective view of another embodiment of a toy brick.

Figure 11:
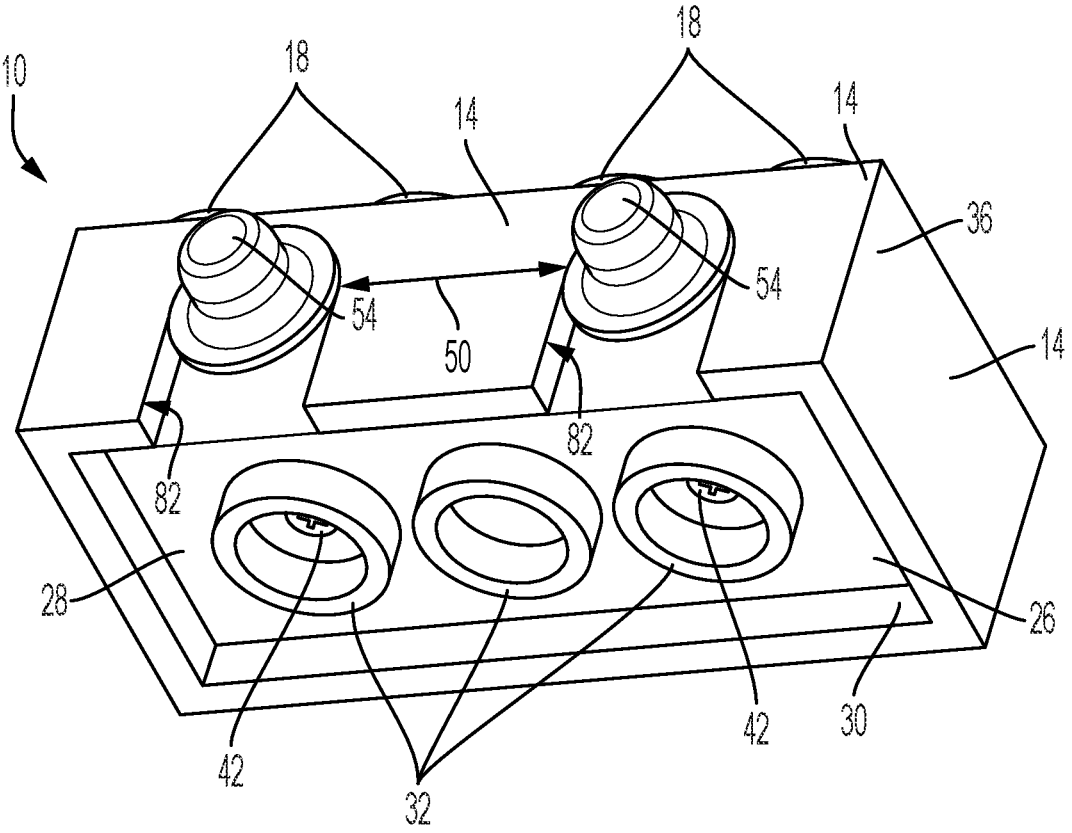

FIG. 11 is a bottom, right perspective view of the toy brick of FIG. 10.

Figure 12:
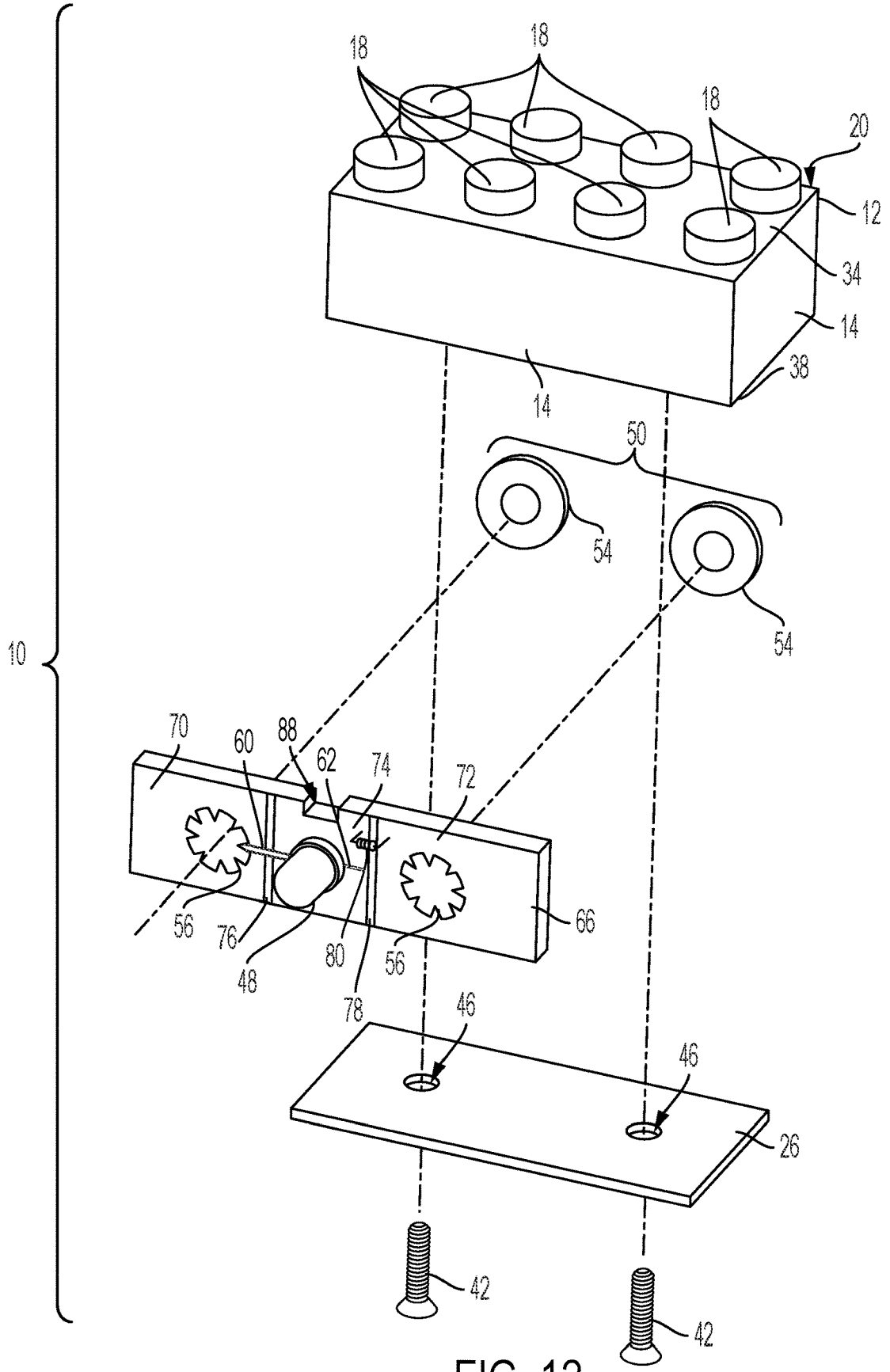

FIG. 12 is a perspective exploded view of the toy brick of FIG. 10.

Figure 13:
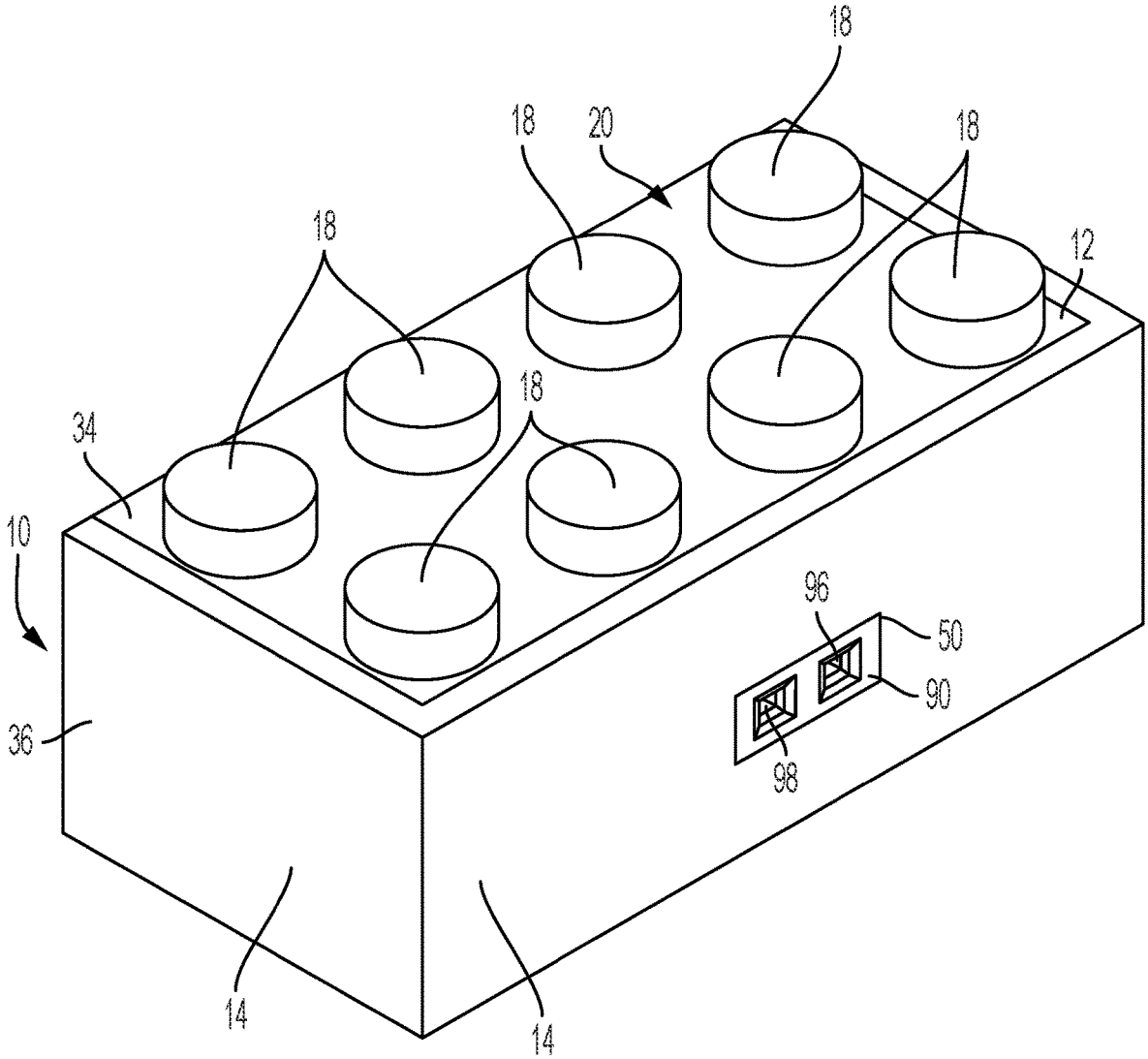

FIG. 13 is a top, right perspective view of another embodiment of a toy brick.

Figure 14:
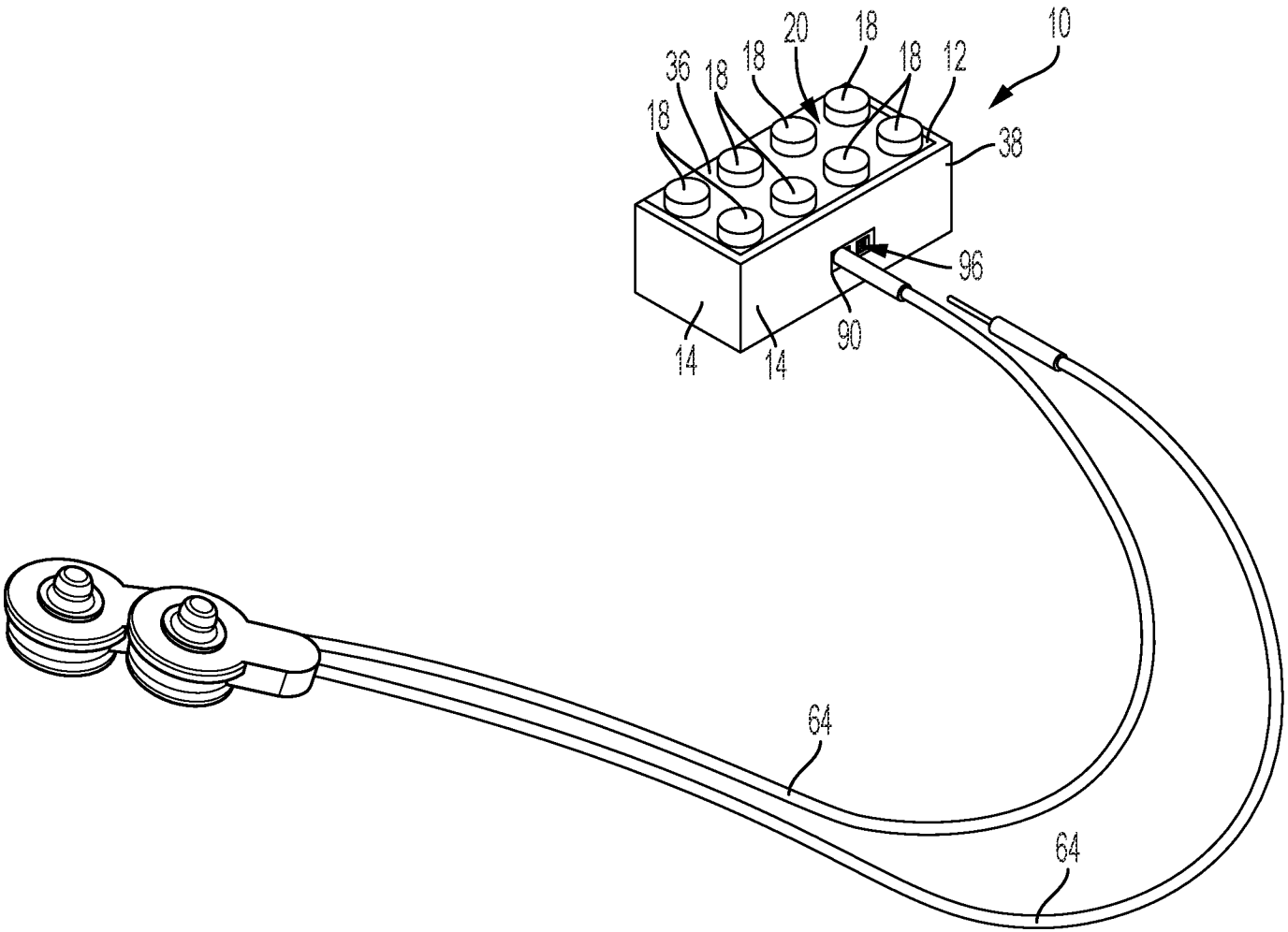

FIG. 14 is a top, right perspective view of the toy brick of FIG. 13 connected to jumper wires.

Figure 15:
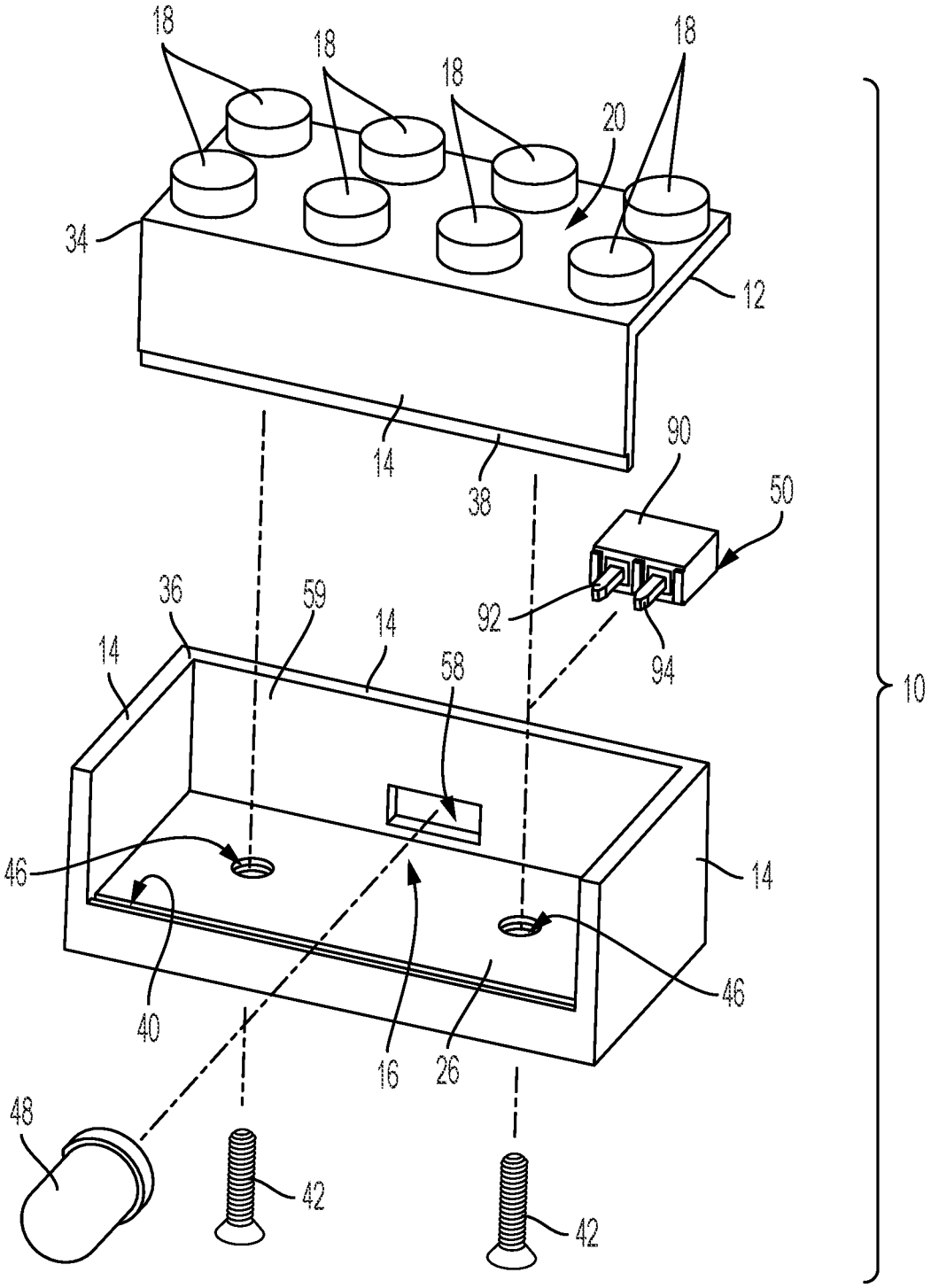

FIG. 15 is a perspective exploded view of the toy brick of FIG. 13.

Figure 16:
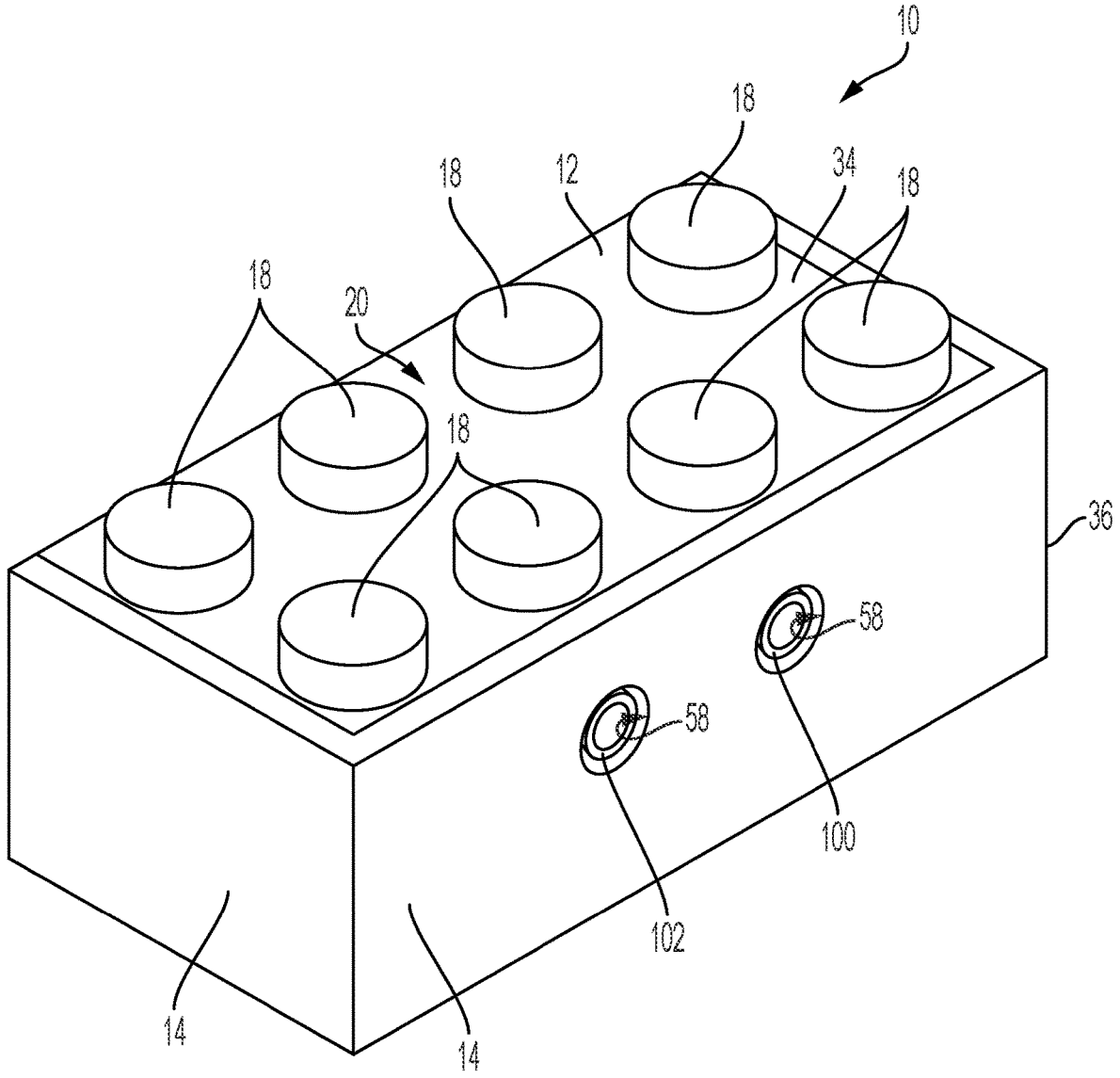

FIG. 16 is a top, right perspective view of another embodiment of a toy brick.

Figure 17:
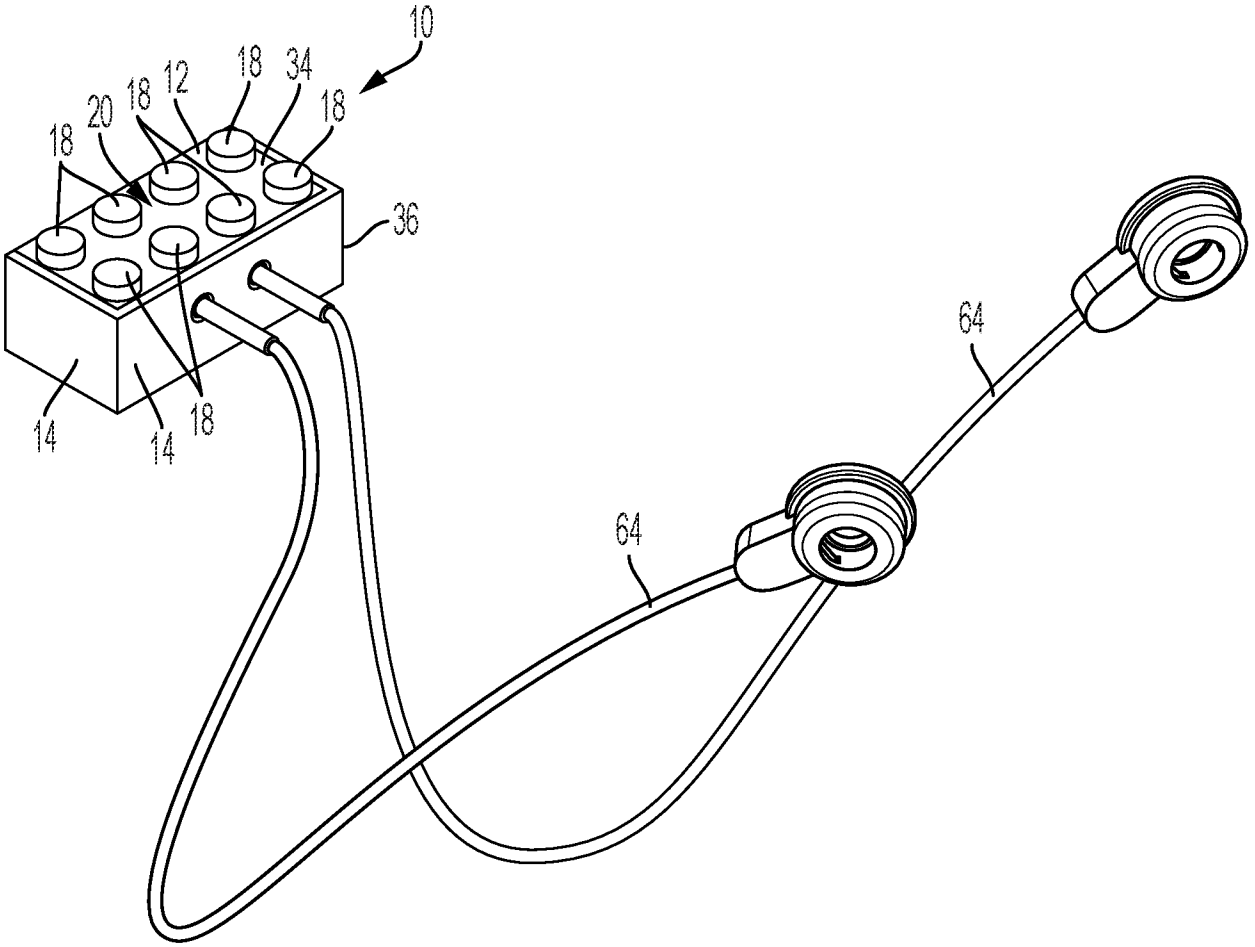

FIG. 17 is a top, right perspective view of the toy brick of FIG. 16 connected to jumper wires.

Figure 18:
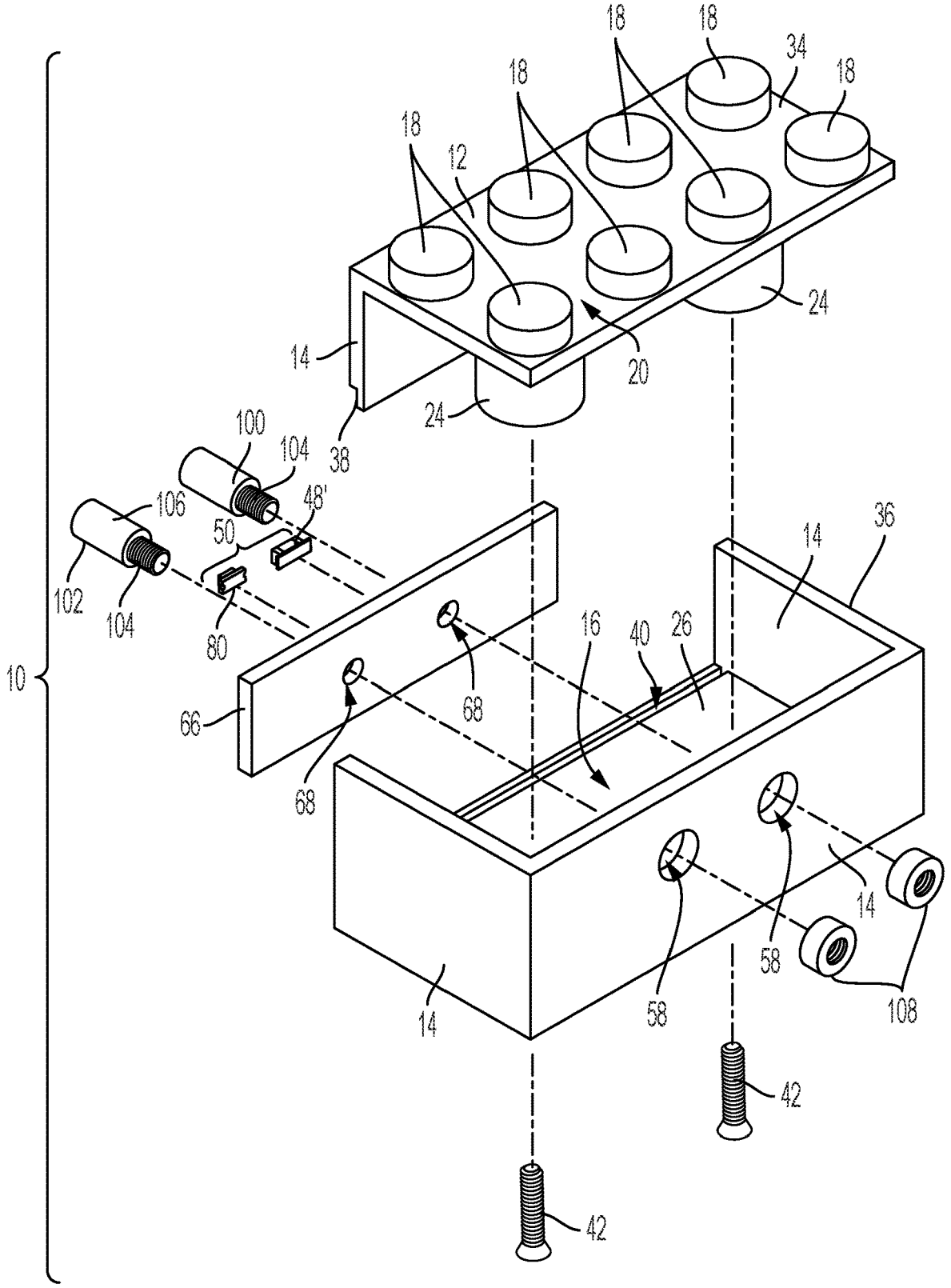

FIG. 18 is a perspective exploded view of the toy brick of FIG. 16.

DETAILED DESCRIPTION

According to one embodiment, a toy brick is configured to be used to create a structure by connecting a number of toy bricks. At least one toy brick is configured to be connected to a power source to provide electricity to the toy brick. The electricity could be used by the brick in a number of different ways including, but not limited to, moving an object (e.g., spinning a fan blade), making noise (e.g., playing a sound), creating heat, and emitting light.

Referring to FIGS. 1-6, one embodiment of a toy brick or building block is a lighted toy brick 10. The embodiment of the brick 10 in FIG. 1 includes a top plate or wall 12 with a number of side walls 14, and in one embodiment, four side walls—a first wall, a second wall, a third wall and a fourth wall, attached to the top plate to create a cavity 16 (as seen in FIG. 4). The walls 14 extend away from the from the exterior face 20 of the top plate 12. The top plate 12 has a plurality of projections 18 extending from the exterior face 20 of the top plate and away from the cavity 16.

On one embodiment seen in FIG. 7, the cavity or interior chamber 16 formed by the walls 14 and the interior face 22 of the top plate 12 is sized to receive the projections from another brick 10' to selectively hold the bricks 10, 10' together. In another embodiment, seen in FIG. 4, the interior face 22 of the top plate 12 may have a number of protrusions 24 that extend into the cavity 16. The protrusions 24 from a brick 10 with no bottom wall 26 may be configured to be received in between the projections 18 from another brick 10' when the bricks 10, 10' are selectively attached. The protrusions 24, in addition to the walls 14, increase the friction between the projections 18 from the second brick 10' and the protrusions and walls to promote a stronger attachment between the bricks as seen in FIG. 2.

In one embodiment, seen in FIG. 3, the brick includes a bottom plate 26 attached to the bottom of the walls 14. As seen in FIG. 4, the bottom plate or wall 26 encloses the cavity 16. In one embodiment, the bottom plate 26 includes a ridge 30 located around at least a portion of the perimeter of the exterior face or side 28 of the bottom plate 26. The ridge 30 surrounds (or creates) a depression 31 formed in the exterior face or side 28 of the bottom plate. The bottom plate 26 may also include one or more knobs 32. The knob(s) 32 and ridge extend from the exterior face 28 and away from the cavity 16. For example, the knob(s) 32 from one brick 10 can engage some of the plurality of projections 18 from a second brick 10' to selectively attach the brick to the second brick as seen in FIG. 2.

The knob(s) 32, in addition to the ridge 30, increases the friction between the projections 18 from the second brick 10' and the knob(s) and ridge to promote a stronger attachment between the bricks. Alternatively, the bottom plate could include pockets sized to receive the projections 18 from a second brick 10' to selectively hold two bricks together as seen in FIG. 8. Further, although the projections, protrusions and knobs are shown as circular in cross-shape, other shapes could be used, including octagonal cross-shapes. Additionally, or alternatively, projections 18, protrusions 24 and/or knobs 32 could be located on the surfaces of other walls, plates and/or faces to allow more ways of connecting bricks and to create different structures.

In one embodiment, the bricks 10 are made from injection molding a plastic, such as acrylonitrile butadiene styrene. However, the bricks could be made from other methods, such as blow molding, three dimensional printing, carving, rotomolding, etc., without defeating the spirit of the invention. Further, the bricks 10 could be made from other materials including other plastics, such as acrylonitrile styrene for transparent or clear bricks, or from wood, metal, glass, etc.

In one embodiment seen in FIGS. 4-5, the brick 10 is formed in two pieces. A first brick piece 34 includes the top plate 12 and a wall 14. And a second brick piece 36 includes the bottom plate 26 and three walls 14. The first brick piece 32 is configured to attach to the second brick piece 34 to form a hollow block. Alternatively, the brick 10 could be formed from individual walls 14, a bottom plate 26 and top plate 12 or, as seen in FIG. 12 a first brick piece 34' that includes the top plate 12 and walls 14 and a second brick piece 36 that is a bottom plate 26 and which is configured to be attached to the first brick piece. The brick 10 could be made from other combinations of walls and/or plates, without defeating the spirit of the invention.

In one embodiment, the first brick piece 34 has a tongue 38 and the second brick piece 36 has a slot 40 formed therein to receive the tongue when the first brick piece is attached to the second brick piece. In one embodiment seen in FIG. 5, the tongue 38 is formed on one of the walls 14 of the first brick piece 34 and the slot 40 is formed in the bottom wall 26 of the second brick piece 36.

In one embodiment seen in FIG. 4, the first brick piece 34 is attached to the second brick piece 36 by screws 42. The first brick piece 34 may have one or more protrusions 24 extending from the interior face 22 of the top plate 12 and into the cavity 16. The protrusions 24 can have a threaded recess, e.g., a tubular shape. The longitudinal axis of each protrusion 24 is lined up with a respective knob 32. Each respective knob 32 has a hole 44 through the bottom plate 26 and which a fastener such as a screw 42 can extend at least partially through to engage the threaded recess to attach the first brick piece 34 to the second brick piece 36. Alternatively, the components of the brick 10 could be attached using a number of known ways of attaching two portions together including by gluing, snap-fitting, ultrasonically welding, etc., without defeating the spirit of the invention.

The brick 10 includes a light device 48 that can be turned on or off. In one embodiment, the light device 48, such as an electric lamp, is located in the cavity 16 of the brick and the light from the light device is emitted out of or passes through the brick 10 as seen in FIG. 5. The light may be emitted or passed through holes in the brick or by making at least a portion of the brick out of a translucent or clear material. In one embodiment, the light device is a light emitting diode, such as a 5 millimeter, red, leaded light emitting diode.

The brick 10 seen in FIG. 1 includes a conductive node 50 electrically connected to the light device 48 to allow electricity from a power source 52 such as a battery holder (part number 6SCB3 available from Elenco Electronics, LLC), to flow to the light device as shown in FIG. 6. One embodiment of a conductive node 50 as seen in FIG. 5, is a pair of conductive snaps 54 and conductive rivets 56. The conductive snaps 54 are attached to a wall 14 of the brick 10, for example, the first wall, by a conductive rivet 56 extending at least partially through a hole 58 in the wall 14 and into the conductive snap to attach the conductive snap to the exterior face 59 of the wall 14.

The light device 48 may have one pin 60, for example the anode or positive pin, attached or electrically connected to a first one of the conductive rivets 56 and a second pin 62, for example the cathode or negative pin, attached or electrically connected to a second one of the conductive rivets 56'. When the conductive snaps 54 are electrically connected to the power source 52, as seen in FIG. 6, the light device 48 will emit light. In one embodiment, a pair of wires 64 (such a jumper wires, part number 6SCJ4 and/or SCJ3A available from Elenco Electronics, LLC) are selectively connected or attached to respective ones of the conductive snaps 54 and the power source 52. The wires 64 allow electricity to flow from one end of the wire to a second end of the wire and, subsequently, from the power source 52 to the conductive node(s) 50. However, other electrical conductive elements could be used to complete the circuit between the conductive node 50 and the power source 52. The conductive node 50 is configured such that when the at least one conductive node receives electricity, the at least one conductive node allows the electricity to flow to the light device 48. And the light device 48 is configured such that when the light device receives electricity, the light device emits a light.

In another embodiment seen in FIG. 9, a circuit board 66 is located behind the wall 14 and in the cavity 16. The conductive rivets 56 extend through a respective hole 68 in the circuit board 66 and through a respective hole 58 in the wall 14 before finally engaging the respective conductive snap 54. The circuit board 66 may include a first conductive strip 70 that is in electrical connectivity with the first conductive rivet 54 and a second conductive strip 72 that is in electrical connectivity with the second conductive rivet 54'. The circuit board 66 may have a third conductive strip 74 separated from the first conductive strip 70 by a first nonconductive strip 76 and separated from the second conductive strip 72 by a second nonconductive strip 78.

In one embodiment seen in FIG. 12, a current limiting resistor 80, such as 330 ohms, ⅛W leaded resistor, is attached at a first end to the third conductive strip 74 and at its second end to the second conductive strip 72 to limit the flow of electrical current or to provide a specific voltage from the power source 52 to the third conductive strip 74. The light device 48, such as a 5 millimeter, red, leaded light emitting diode can have a first pin attached to the first conductive strip 70 and its second pin connected to the third conductive strip 74. This configuration will help protect the light device 48 from damage such as by being supplied too much current or voltage. Alternatively, the light device 48 may itself have a resistor 80 built into it or no resistor may be used at all.

In another embodiment seen in FIG. 12, the conductive node 50, such as the conductive snaps 54 and conductive rivets 56, and the light device 48 and resistor 80 (if any) could be attached to a circuit board 66. The wall 14 of the brick 10 may include a notch 82 for each conductive snap 54 such that the circuit board 66 can be slid into the cavity 16 and behind the wall. The interior face 84 of the wall 14 can include a latch 86 (seen in FIG. 10) that engages a nock 88 in the circuit board 66 to hold the circuit board in place, such as in the cavity 16.

In another embodiment as seen in FIGS. 13-18, the conductive node 50 is a pin connector 90. As seen in FIG. 15, the wall 14 of the brick 10 may have a hole 58 sized and shaped to receive the pin connector 90. The pin connector 90 may be held in the hole 58 by friction fit, gluing, ultrasonic welding or other means known in the art for attaching two such components. In one embodiment, the pin connector 90 is extended through the hole 58 in the wall 14 and attached to a circuit board such that the first pin contact 92 of the pin connector 90 is electrically connected to the first conductive strip 70 and the second pin contact 94 of the pin connector is electrically connected to the third conductive strip 74 (or second conductive strip 72 if not using a separate resistor 80). A pair of jumper wires 64, as seen in FIG. 14, with at least one end being a pin (part number 6SCJ10 available from Elenco Electronics, LLC) are connected to the power source 52 (such as seen in FIG. 6) and respective ones of the pin receptacles 96, 98 of the pin connector 90, which are exposed through the exterior face of the wall 14. The first and second pin receptacles 96, 98 of the pin connector 90 are electrically coupled to the first and second pin contacts 92, 94 respectively.

As seen in FIGS. 16-18, the pin connector 90 may be separated into a first pin housing 100 and a second pin housing 102 that extends through a first hole 58 in the wall 14 and a second hole 58' respectively such that one end of the pin housings 100, 102 are exposed through the exterior face of the wall. In one embodiment seen in FIG. 18, the pin housings 100, 102 have a threaded end 104 that is smaller than the hole 58 in the wall 14 and body 106 that is larger than the hole. The pin housings 100, 102 are attached to the wall 14 by having a threaded end 104 extend through the hole 58 and nuts 108 threaded onto the threaded ends 104 to hold the wall and circuit board 66 (if being used) between the nuts and the bodies 106.

The first pin housing 100 is electrically connected to the first conductive strip 70 and the second housing 102 is electrically connected to the third conductive strip 74 (or second conductive strip 72 if not using a separate resistor 80). A pair of jumper wires 64 with at least one end being a pin are connected to respective ones of the pin housings 100, 102 and the power source 52 (such as seen in FIG. 6). Or, alternatively, if no circuit board 66 is used, the first pin 60 of the light device 48' is electrically connected to the first pin housing 100 and the second pin 62 of the light device is electrically connected to the second pin housing 102.

Other components could additional be used with the brick 10, such as, a switch (e.g., part number 6SCS1 available from Elenco Electronics, LLC). Further, the brick 10 could include additional conductive nodes to electronically couple a number of bricks or other devices together. Although the conductive node has been described as at least two conductive components, such as snaps and pins, the conductive node could be a single conductive component such as a socket, e.g., a stereo jack, without defeating the spirit of the invention.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein. Further, although certain advantages of different embodiments and disadvantages of certain prior art are described, no single claim must realize every or any benefit or overcome every or any disadvantage.

What is claimed is:

1. A toy brick comprising:

a top plate with an exterior face;

a first wall, a second wall and a third wall attached to the top plate and extending away from the exterior face to form a cavity;

a plurality of non-conductive projections extending from the exterior face;

a first conductive node and a second conductive node attached to the first wall; and a light device located in the cavity and electrically connected to the at least one conductive node;

wherein the at least one conductive node is configured such that when the at least one conductive node receives electricity, the at least one conductive node allows the electricity to flow to the light device;

wherein the light device is configured such that when the light device receives electricity, the light device emits a light; and wherein at least one of the first wall, second wall and third wall is configured such that when the light device emits a light, the light passes through the at least one of the first wall, second wall and third wall.

2. The toy brick of claim 1, wherein the first wall as an exterior face;

wherein the first conductive node is a first conductive snap and a first conductive rivet;

wherein the second conductive node is second conductive snap and a second conductive rivet;

wherein the first conductive rivet extends at least partially through a first hole in the first wall and into the first conductive snap to attach the first conductive snap to the exterior face of the first wall; and wherein the second conductive rivet extends at least partially through a second hole in the first wall and into the second conductive snap to attach the second conductive snap to the exterior face of the first wall.

3. The toy brick of claim 2, wherein the light device has a first pin and a second pin;

wherein the first pin is electrically connected to the first conductive rivet; and wherein the second pin is electrically connected to the second conductive rivet.

4. The toy brick of claim 3, wherein the first pin and the first conductive rivet are electrically connected to a first conductive strip of a circuit board; and wherein the second pin and the second conductive rivet are electrically connected to a second conductive strip of the circuit board.

5. The toy brick of claim 3, wherein the first pin and the first conductive rivet are electrically connected to a first conductive strip of a circuit board;

wherein the second conductive rivet is electrically connected to a second conductive strip of the circuit board;

wherein a first end of a resistor is electrically connected to a third conductive strip of the circuit board and a second end of the resistor is electrically connected to the second conductive strip; and wherein the second pin is electrically connected to the third conductive strip.

6. The toy brick of claim 5, wherein the circuit board is located in the cavity.

7. The toy brick of claim 6, wherein the first wall has an interior face;

wherein the interior face has a latch;

wherein the circuit board has a nock; and wherein the latch engages the nock to hold the circuit board in the cavity.

8. The toy brick of claim 1, further comprising a pin connector;

wherein the pin connector has a first pin receptacle, a second pin receptacle, a first pin contact and a second pin contact;

wherein the first conductive node is the first pin receptacle and the first pin contact;

wherein the second conductive node is the second pin receptacle and the second pin contact;

wherein the pin connector extends through a hole in the first wall such that the first pin receptacle and the second pin receptacle are exposed through an exterior face of the first wall;

wherein the first pin receptacle is electrically connected to the first pin contact; and wherein the second pin receptacle is electrically connected to the second pin contact.

9. The toy brick of claim 1, wherein the first wall as an exterior face;

wherein the first conductive node is a first pin housing;

wherein the second conductive node is a second pin housing;

wherein the first pin housing extends through a first hole in the first wall such that one end of the first pin housing is exposed through the exterior face; and wherein the second pin housing extends through a second hole in the first wall such that one end of the second pin housing is exposed through the exterior face.

10. The toy brick of claim 9, wherein the one end is a threaded end;

wherein the threaded end of the first pin housing extends at least partially through the first hole;

wherein a first nut is threaded onto the threaded end of the first pin housing to attach the first pin housing to the exterior face of the first wall;

wherein the threaded end of the second pin housing extends at least partially through the second hole; and wherein a second nut is threaded onto the threaded end of the second pin housing to attach the second pin housing the exterior face of the first wall.

11. The toy brick of claim 10, wherein the light device has a first pin and a second pin;

wherein the first pin is electrically connected to another end of the first pin housing;

wherein the second pin is electrically connected to another end of the second pin housing; and wherein the light device is configured such that when the first pin and the second pin receive electricity, the light device emits a light.

12. The toy brick of claim 1, further comprising at least one jumper wire;

wherein the at least one jumpier wire is configure to allow electricity to flow from one end of the at least one jumpier wire to a second end of the at least one jumper wire; and wherein the jumper wire is configured to selectively attach to the at least one conductive node.

13. A building brick comprising:

a hollow block having an interior chamber;

a first conductive node extending through a first wall of the hollow brick;

a second conductive node extending through the first wall of the hollow brick;

an electric lamp located in the interior chamber and electrically connected to the first conductive node and the second conductive node;

wherein a top of the hollow block has a plurality of projections extending away from the interior chamber, the plurality of projections configured to attach the building brick to another building brick;

wherein the building brick is attached to the another building brick, the first conductive node and the second conductive node are exposed; and wherein the electric lamp is configured such that when electricity is received by the first conductive node and the second conductive node, the electric lamp emits a light.

14. The building brick of claim 13, wherein the hollow block is formed by a first block piece attached to a second block piece.

15. The building brick of claim 14, wherein the first block piece further comprises a top wall and at least one side wall; and wherein the second block piece comprises a bottom wall and at least one side wall.

16. The building block of claim 15, wherein the bottom wall has an exterior face;

wherein the exterior face has a ridge located around at least a portion of a perimeter of the exterior face;

wherein the exterior face has at least one knob;

wherein the ridge and the at least one knob extend from the exterior face and away from the interior chamber.

17. The building block of claim 16, wherein the top wall has at least one protrusion extending from an interior face of the top wall and into the interior chamber;

wherein the at least one protrusion has a threaded recess;

wherein the at least one knob has a hole and the hole extends through the bottom wall; and wherein a fastener extends through the hole and into the threaded recess to attach the first block piece to the second block piece.

18. The building block of claim 16, wherein the at least one knob is configured to engage at least some of a plurality of projections from a second building block to selectively attach the building block to the second building block.

19. The building block of claim 15, wherein the at least one wall of the first block piece has a tongue;

wherein a slot is formed in the bottom wall;

wherein the slot is configured to receive the tongue when the first block piece is attached to the second block piece.

20. The building brick of claim 14, wherein the first block piece further comprises a top wall and at least one side wall and wherein the second block piece comprises a bottom wall.

21. The building brick of claim 13, further comprising a power source, a first wire and a second wire;

wherein the first wire is selectively attached to the power source and the first conductive node; and wherein the second wire is selectively attached to the power source and the second conductive node.

22. A method of illuminating a toy brick comprising:

attaching a first wire to a power source;

attaching a second wire to the power source;

attaching the first wire to a conductive node located on a first wall of a toy block in electrical connectivity with a light device located in a cavity of the toy brick;

attaching the second wire to a second node located on the first wall of the toy block in electrical connectivity with a light device located in a cavity of the toy brick such that when the first wire is attached to the first conductive node and the power source and the second wire is attached to the second conductive node and the power source the light device emits a light and the light passes through the toy brick.

* * * * *